US005364750A

United States Patent [19]

Yoshida et al.

[11] Patent Number: 5,364,750

[45] Date of Patent: Nov. 15, 1994

[54] DIRECT POSITIVE SILVER HALIDE PHOTOSENSITIVE MATERIAL

[75] Inventors: Tetsuo Yoshida; Tatsuo Heki, both of Minami-Ashigara, Japan

[73] Assignee: Fuji Photo Film Co., Ltd., Minami-Ashigara, Japan

[21] Appl. No.: 139,865

[22] Filed: Oct. 22, 1993

Related U.S. Application Data

[63] Continuation of Ser. No. 790,091, Nov. 5, 1991, abandoned, which is a continuation of Ser. No. 634,967, Jan. 3, 1991, abandoned, which is a continuation of Ser. No. 374,749, Jul. 3, 1989, abandoned, which is a continuation-in-part of Ser. No. 171,643, Mar. 22, 1988, abandoned, which is a continuation-in-part of Ser. No. 945,883, Dec. 24, 1986, abandoned.

[30] Foreign Application Priority Data

| | | | |
|---|---|---|---|
| Dec. 24, 1985 | [JP] | Japan | 60-291011 |
| Feb. 20, 1986 | [JP] | Japan | 61-36423 |
| Apr. 17, 1986 | [JP] | Japan | 61-88627 |

[51] Int. Cl.[5] ..... G03C 1/09; G03C 1/035

[52] U.S. Cl. ..... 430/509; 430/567; 430/571; 430/598; 430/599

[58] Field of Search ..... 430/506, 509, 567, 569, 430/570, 571, 598, 599

[56] References Cited

U.S. PATENT DOCUMENTS

| | | | |
|---|---|---|---|
| 4,444,865 | 4/1984 | Silverman et al. | 430/217 |
| 4,444,874 | 4/1984 | Silverman et al. | 430/409 |
| 4,446,228 | 5/1984 | Honda et al. | 430/567 |
| 4,521,507 | 6/1985 | Iijima et al. | 430/503 |
| 4,554,245 | 11/1985 | Hayashi et al. | 430/567 |
| 4,643,965 | 2/1987 | Kubota et al. | 430/567 |
| 4,701,404 | 10/1987 | Iijima et al. | 430/559 |
| 4,724,198 | 2/1988 | Yamada et al. | 430/506 |
| 4,752,558 | 6/1988 | Shimura et al. | 430/505 |

*Primary Examiner*—Janet C. Baxter

*Attorney, Agent, or Firm*—Burns, Doane, Swecker & Mathis

[57] ABSTRACT

The present invention relates to a direct positive photosensitive material comprising at least two kinds of core/shell-type internal latent image-type silver halide grains having different average grain sizes, the smaller grains being substantially constituted of cubic grains, or tetradecahedron grains mainly of the face (100). According to the present invention, a direct positive photosensitive material having a wide exposure latitude and an extremely improved storage stability can be obtained.

15 Claims, 2 Drawing Sheets

DIRECT POSITIVE SILVER HALIDE PHOTOSENSITIVE MATERIAL

This application is a continuation of application Ser. No. 07/790,091, filed Nov. 5, 1991, now abandoned, which is a continuation of application Ser. No. 07/634,967, filed Jan. 3, 1991, now abandoned, which is a continuation of application Ser. No. 07/374,749, filed Jul. 3, 1989, now abandoned, which is a CIP of Ser. No. 07/171,643, filed Mar. 22, 1988, now abandoned, which is a CIP of 06/945,883, filed Dec. 24, 1986, now abandoned.

BACKGROUND OF THE INVENTION

1. Field of the Invention

The present invention relates to a direct positive silver halide photosensitive material, and in particular, to a direct positive silver halide photosensitive material which has a wide exposure latitude and a remarkably improved storage stability.

2. Description of the Prior Art

Methods are known wherein a reversed image can be obtained by chemically sensitizing the surfaces of internal latent image-type silver halide grains composed of (1) a silver halide core which is doped with a metal ion and/or chemically sensitized and (2) a silver halide shell coating at least a sensitive site of the core (hereinafter referred to as a core/shell-type grain), and then developing the core/shell-type grains in the presence of a fogging agent or according to a direct reversal method wherein the development is conducted under overall light exposure. Examples of such methods are described in U.S. Pat. Nos. 3,317,322 and 3,761,276.

The exposure latitude of direct positive photosensitive materials comprising the core/shell-type grains is widened usually by a process wherein emulsions of core/shell-type grains having various average grain sizes are prepared and mixed together, or by a process wherein a laminate of an outer layer comprising grains of a larger size and an inner layer comprising grains of a smaller size, is formed. The latter process is preferred to the former, since a wider exposure latitude can be obtained, and the amounts of stabilizer and spectral sensitizing dye adsorbable on the silver halide grains can be freely controlled in respect of the size of the grains to be used.

In applications of microphotography, duplication, etc., wherein good graininess and resolving power are required, silver halide grains having a smaller grain size are advantageous and the development of fine grain core/shell-type silver halide emulsion has been required. To produce such a fine grain core/shell-type emulsion, a process is known wherein the degree of chemical sensitization for the core is increased as described in Patent Disclosure No. 59-20854. However, such a wide exposure latitude photosensitive material using the smaller size core/shell-type silver halide grains in the fine grain core/shell-type emulsion has several defects. For example, when it is stored at a high temperature in an atmosphere of a high humidity or even at room temperature for a long period of time, its properties are largely changed. For example, its $D_{max}$ is reduced, the development speed is lowered, and a long development time is required for obtaining a sufficient $D_{max}$.

For overcoming the above-mentioned defects, there has been proposed a process wherein a well-known stabilizer such as 4-hydroxy-6-methyl-1,3,3a,7-tetrazaindene or 1-phenyl-5-mercaptotetrazole is used, and processes which are directed to improving the storage stability of direct positive photosensitive materials, wherein a stabilizer such as those mentioned in Patent Disclosure Nos. 57-86829 and 60-95533, is used. However, these processes are still unsatisfactory, since sufficient effects cannot be obtained or $D_{min}$ is increased.

SUMMARY OF THE INVENTION

In order to resolve the above problems, the present inventors have made an intensive study and unexpectedly found that the above problems can be resolved by using at least two types of core/shell-type internal latent image-type silver halide grains having different grain sizes, the smaller size grains being substantially constituted of cubic grains or tetradecahedron grains mainly of the lattice face (100).

An object of the present invention is, therefore, to provide a direct positive photosensitive material which has high storage stability and wide exposure latitude.

Another object of the invention is to provide a direct positive photosensitive material which has high developing speed, wide exposure latitude, and good graininess.

These and other objects of this invention will be clear from the following description.

In accordance with the present invention, there is provided a direct positive photosensitive material having, on a support, at least one internal latent image-type silver halide emulsion comprising core/shell-type silver halide grains and a binder, wherein the core/shell-type silver halide grains include at least two types of grains having different grain sizes, and the smaller grain size grains are substantially constituted of cubic grains or tetradecahedron grains mainly of the face (100), wherein the smaller grains have an average grain size of 0.5 μm or smaller and a sensitivity which is 2 to 20% of the sensitivity of the larger grains.

DETAILED DESCRIPTION OF THE PREFERRED EMBODIMENTS

Figure 1:
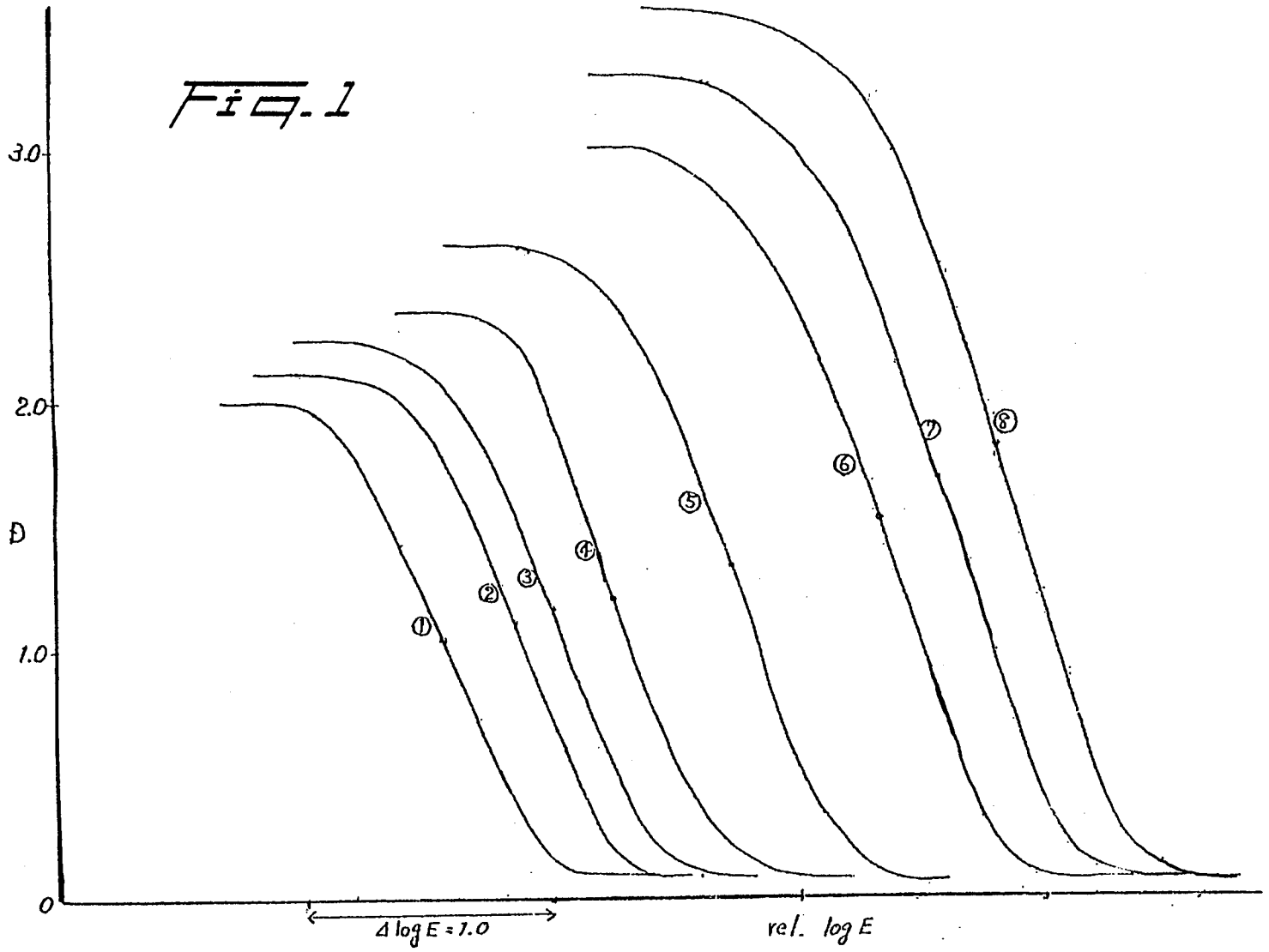
FIGS. 1 and 2 illustrate the results obtained in Example 13.

The core/shell-type silver halide grains to be used in the present invention are preferably monodispersed grains. Excellent results are obtained when these grains have an average grain diameter of about 0.1 to 4 μm, particularly about 0.2 to 3 μm.

The term "monodispersed grain" herein indicates that the silver halide grains have substantially the same diameter. Preferred silver halide grains used in the present invention are those up to 95% of which have a diameter within a value of the average grain diameter ±40%, particularly the average grain diameter +20%.

The term "tetradecahedron mainly of the face (100)" herein indicates that at least 60% of the surface area of the grains comprises the face (100). The term "substantially cubic grains or tetradecahedron grains mainly of the face (100)" indicates that preferably at least 50%, more preferably at least 80%, and particularly at least 95% of the grains contained in the core/shell-type emulsion are in the form of cubes and/or tetradecahedron grains mainly of the face (100).

The proportion of the face (100) occupying the silver halide grain surface can be easily determined by a method wherein a dye having a face selectivity (adsorbability) is adsorbed thereon and then the absorption spectrum thereof is determined with a spectrophotometer. This method is described in detail in Journal of Imaging Science, 29, 165 (1985).

The internal latent image-type silver halide emulsion preferably contains two or more grains which are different in an average grain diameter, halogen composition, crystal habit, employment of chemical sensitization, and its condition, in order to obtain a wider exposure latitude. Specifically, the emulsion preferably contains two, three or four kinds of grains. These grains may be present in the same emulsion layer or different emulsion layers.

In the multi-emulsion layer system, for example, two, three or four emulsion layers may be employed.

The internal latent image-type silver halide emulsions having different color sensitivities (for example, red sensitivity, green sensitivity and blue sensitivity) may be used in multi-layer system.

To obtain a more preferred exposure latitude, it is desirable that an emulsion layer comprising the core/-shell-type silver halide grains having a smaller average grain size is placed closely to the support (preferably, inner-most layer) and that having a larger average grain size is placed remotely from the base (preferably outer layer).

It is preferable that the difference between the average grain sizes of two or more kinds of core/shell-type silver halide grains is 20% or more. To obtain a wide exposure latitude, the grain size of the smallest core/-shell-type silver halide grains is preferably 0.15–0.5 μm, more preferably 0.15–0.40 μm.

The silver halide grains having a smaller grain size and being substantially constituted of cubic grains or tetradecahedron grains mainly of the face (100), are preferably used in the amount of preferably 20–80 wt.%, more preferably 30 –70 wt. %.

It is preferable that the average grain size of the silver halide grains used in the inner-most layer is 80% or less of that of the silver halide grains used in the other emulsion layers.

The smaller grains should have a sensitivity of 2 to 20% of that of the larger grains. If the relative sensitivity of the smaller grains is less than 2% of that of the larger grains, gradation having poor linearity will be obtained. On the other hand, broad latitude will be obtained if the smaller grains have a sensitivity which is 2% to 20% of that of the larger grains.

The core/shell-type silver halide grains constituting the emulsion of the present invention are prepared by forming a silver halide core which has been chemically sensitized and/or doped with a metal ion, coating the core with a silver halide to form the shell, and then chemically sensitizing the shell. It is not necessary to cover the whole surface of the core grain with the shell. At least a sensitive site of the core (i.e., a site for forming silver by the photolysis upon the exposure) is to be coated.

The cores of the core/shell-type silver halide grains are chemically sensitized by a process disclosed in Glafkides, "Chimie et Physique Photographique" (Paul Montel Co., 1967), V. L. Zelikman et al. "Making and Coating Photographic Emulsion" (The Focal Press Co., 1964), or H. Frieser "Die Grundlagen der Photographischen Prozesse mit Silberhalogeniden" (Akademische Varlagsgesellschaft, 1968).

The sensitization is effected by a sulfur sensitization process wherein a sulfur-containing compound reactive with silver ion or active gelatin is used, a reduction sensitization process wherein a reducing substance is used, or a noble metal sensitization process wherein a noble metal compound such as gold is used. These processes can be employed either singly or as a combination thereof. The most preferred results are obtained by the combination of the gold sensitization process with the sulfur sensitization process and, if necessary, the reduction sensitization process. The sulfur sensitizers include, for example, thiosulfates, thioureas, thiazoles and rhodanines. Examples of these compounds are mentioned in U.S. Pat. Nos. 1,574,944, 2,410,689, 2,278,947, 2,728,668 and 3,656,955. The reduction sensitizers include, for example, stannous salts, amines, hydrazine derivatives, formamidinesulfinic acid, and silane compounds. Examples of these compounds are mentioned in U.S. Pat. Nos. 2,487,850, 2,419,974, 2,518,698, 2,983,609, 2,983,610 and 2,694,637. Noble metal salts used for the sensitization include, as well as gold complex salts, complex salts of metals of Group VIII in the Periodic Table such as platinum, iridium, and palladium. Examples of these compounds are mentioned in U.S. Pat. Nos. 2,399,083 and 2,448,060, and British Patent No. 618,061.

Although the conditions of the chemical sensitization step are not particularly limited, preferred results are obtained under condition that a pH is 9 or below, pAg is 10 or below, and temperature is 40° C. or higher. However, as the case may be, the conditions may be set beyond this condition.

The core is chemically sensitized and/or doped with a metal ion. The core can be doped with the metal ion by, for example, using a metal ion source such as a cadmium salt, zinc salt, lead salt, thallium salt, iridium salt or iridium complex salt, rhodium salt or rhodium complex salt, or iron salt or iron complex salt in the step of forming the silver halide grains for the core or in the physical aging step. The metal ion is used usually in an amount of at least 10-6 mol per mol of the silver halide.

Processes for treating the silver halide of the core and processes for coating the surfaces of the core silver halide grains with the shell-forming silver halide have been well known. For example, processes disclosed in U.S. Pat. Nos. 3,206,316, 3,317,322, 3,367,778 (excluding the step of fogging the grain surfaces), and 3,761,276 can be employed advantageously.

The ratio of the core-forming silver halide to the shell-forming silver halide is not particularly limited. The molar ratio of the former to the latter is usually 2 to 10.

While the composition of the core silver halide is preferably the same as that of the shell silver halide, they may be different from each other. Examples of the silver halides usable in the present invention include silver bromide, silver iodide, silver chloride, silver chlorobromide, silver bromoiodide, and silver chlorobromoiodide. A preferred silver halide emulsion contains at least 50 molar % of silver bromide. The most preferred emulsion is a silver bromide or silver bromoiodide emulsion. Particularly preferred is an emulsion containing silver bromide or silver bromide containing less than about 10 molar % of silver iodide.

The silver halide grains of core/shell-type to be used in the present invention may be in a regular crystalline form such as cubes, tetradecahedrons or hexahedrons, in an irregular crystalline form such as spheres or plates, in complex crystal form thereof, or a mixture of the grains of various crystalline forms.

The surfaces of the thus prepared core/shell-type silver halide grains are then chemically sensitized. The chemical sensitization process employed in this step may be the same as the above-mentioned process employed for the chemical sensitization of the cores. As a matter of course, the chemical sensitization of the surfaces of the core/shell-type silver halide grains is effected in such a manner that the properties of them as the internal latent image-type grains are not damaged. The term "properties of the internal latent image-type grains" indicates that when the silver halide emulsion is applied to a transparent support, exposed for a given time of 0.01 to 10 sec., and developed with the following developer A (internal developer) at 20° C. for 3 min., the maximum density determined by a usual photographic density-measuring method is at least 5 times as high as a maximum density obtained by developing the above exposed silver halide emulsion in the following developer B (surface developer) at 20° C. for 4 min.

| | | |
|---|---|---|
| Developer A: | | |
| hydroquinone | | 15 g |
| monomethyl-p-aminophenol sesquisulfate | | 15 g |
| sodium sulfite | | 50 g |
| potassium bromide | | 10 g |
| sodium hydroxide | | 25 g |
| sodium thiosulfate | | 20 g |
| water | | 1 l |
| Developer B: | | |
| p-hydroxyphenylglycine | | 10 g |
| sodium carbonate | | 100 q |
| water | add | 1 l |

The core/shell-type silver halide grains of the present invention are dispersed in the binder as known in the art.

Although preferred binders are gelatins, other hydrophilic colloids can also be used.

Examples of the binders include proteins such as gelatin derivatives, graft polymers of gelatin and other polymers, albumin, and casein; cellulose derivatives such as hydroxyethylcellulose, carboxymethylcellulose and cellulose sulfate; and sugar derivatives such as sodium alginate and starch derivatives.

The gelatins include those treated with lime, with an acid, or with oxygen as mentioned in Bull. Soc. Sci. Photo. Japan, No. 16, p. 30 (1966). Further, hydrolyzates of gelatins and enzymatic decomposition products of them can also be used.

The internal latent image-type silver halide photographic emulsion of the present invention can be spectrally sensitized with a dye such as a methine dye. The dyes usable in the present invention include cyanine, merocyanine, complex cyanine, complex merocyanine, holopolar cyanine, hemicyanine styryl, and hemioxonol dyes. Among them, preferred are cyanine, merocyanine, and complex merocyanine dyes. These dyes may have any of nuclei which are used for cyanine dyes as basic heterocyclic nuclei. Examples of the nuclei include pyrroline, oxazoline, thiazoline, pyrrole, oxazole, thiazole, selenazole, imidazole, tetrazole and pyridine nuclei; these nuclei fused with an alicyclic hydrocarbon ring or an aromatic hydrocarbon ring such as indolenine, benzindolenine, indole, benzoxazole, naphthoxazole, benzothiazole, naphthothiazole, benzoselenazole, benzimidazole and quinoline nuclei. These nuclei may have a substituent bonded with the carbon atom.

The merocyanine or complex merocyanine dyes may have a 5 or 6-membered heterocyclic nucleus such as pyrazolin-5-one, thiohydantoin, 2-thioxazolidin-2,4-dione, thiazolidin-2,4-dione, rhodanine and thiobarbituric acid nuclei as the nucleus having the ketomethylene structure.

The useful sensitizing dyes are those mentioned in, for example, German Patent No. 929,080, U.S. Pat. Nos. 2,231,658, 2,493,748, 2,503,776, 2,519,001, 2,912,329, 3,655,394, 3,656,959, 3,672,897, 3,694,217, British Patent No. 1,242,588, and Japanese Patent Publication No. 44-14030.

The methine dyes particularly useful in the present invention are cyanine dyes having benzoxazole or naphthoxazole nucleus as the basic heterocyclic nucleus.

It is particularly preferable that the spectral sensitization is made with such cyanine dyes. Examples of particularly useful sensitizing dyes are as follows:

D-1

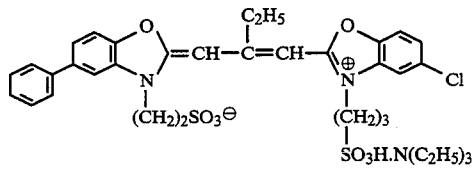

D-2

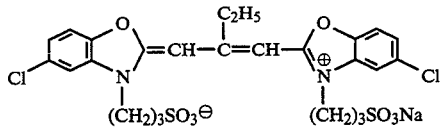

D-3

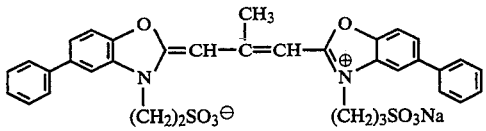

D-4

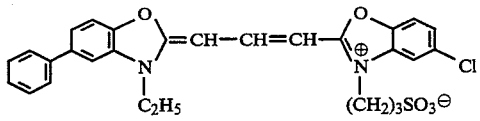

D-5

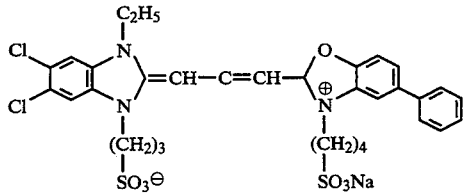

D-6

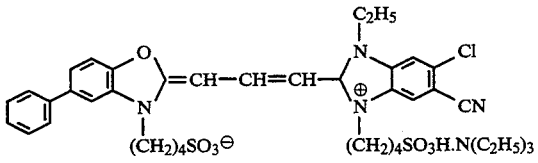

D-7

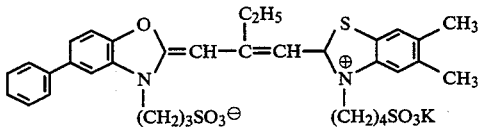

-continued

D-8

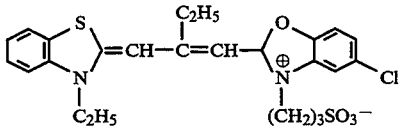

The sensitization dye may be present at any stages of the manufacture of the photographic emulsion, i.e., at any stages from the emulsion production to just before the emulsion coating. The former includes the steps of forming silver halide grains, physical ripening, chemical ripening, etc.

These sensitizing dyes may be used either singly or as a combination thereof. The combination of the sensitizing dyes is frequently used for the purpose of the supersensitization. Typical examples of the combinations are given in, for example, U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Patent No. 1,344,281, and Japanese Patent Publication No. 43-4936.

In the preparation of a photosensitive material using the internal latent image-type silver halide photographic emulsion of the present invention, this emulsion is applied to the support together with, if necessary, another photographic layer-forming material. Although the amount of the emulsion to be applied is not limited, a preferred reversed image can be obtained usually when the amount of silver is about 40 to 800 mg per $ft^2$ of the support.

The supports as mentioned in Research Disclosure Vol. 176 RD-17643 XVII (1978) can be used.

The internal latent image-type silver halide photographic emulsion of the present invention may further contain, for example, polyalkylene oxides, their derivatives such as ethers, esters and amines, thioether compounds, thiomorpholines, quaternary ammonium salts, urethane derivatives, urea derivatives, imidazole derivatives and 3-pyrazolidones, so as to improve the sensitivity and contrast or to accelerate the development. These additives are mentioned in, for exampled U.S. Pat. Nos. 2,400,532, 2,423,549, 2,716,062, 3,617,280, 3,772,021, 3,808,003, etc.

The internal latent image-type silver halide photographic emulsion may contain an antifoggant and a stabilizer. Namely, the present photographic emulsion may contain various compounds in order to prevent the fogging during the production, storage or photographic treatment of the photosensitive materials, or to stabilize the photographic properties thereof. There may be used various compounds which are known as an antifoggant or stabilizer, for example, azoles such as benzothiazolium salts, nitroimidazoles, nitrobenzimidazoles, chlorobenzimidazoles, bromobenzimidazoles, benzotriazoles, aminotriazoles; mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyridines, mercaptotriazines; thioketo compounds such as oxadrinthione; azaindenes such as triazaindenes, tetrazaindenes (in particular, 4-hydroxy substituted (1,3,3a,7) tetrazaindenes), pentazaindenes; benzenethiosulfonic acid; benzenesulfinic acid; benzenesulfonamide. Specifically, those compounds described in Research Disclosure, Vol. 176 RD-17643 (1978) VI can be used.

The internal latent image-type silver halide photographic emulsion of the present invention may contain a developing agent. The developing agents usable in the present invention are mentioned in research Disclosure, Vol. 176 RD-17643 (1978) XX.

The present internal latent image-type silver halide grains can be dispersed in a colloid which can be hardened with various organic or inorganic hardeners. The hardeners include, for example, chromium salts such as chromium alum, chromium acetate; aldehydes such as formaldehyde, glyoxal, glutaric aidehyde; N-methylol compounds such as dimethylol urea, methyloldimethylhydantoin; dioxane derivatives such as 2,3-dihydroxydioxane; active vinyl compounds such as 1,3,5-triacryloylhexahydro-s-triazine, bis(vinylsulfonyl) methylethen, N,N'-methylene bis[beta-(vinylsulfonyl) propionamide]; active halogen compounds such as 2,4-dichloro-6-hydroxy-s-triazine; mucohalogenic acid such as mucochloric acid, mucophenoxychloric acid; isoxazbles; dialdehyde starch; 2-chloro-6-hydroxytriazinyl starch. These compounds may be used singly or as a combination thereof. Among them, preferred are the active vinyl compounds described in Japanese Patent Disclosure Nos. 53-41221, 53-57257, 59-162546 and 60-80846 and the active halide compounds described in U.S. Pat. No. 3,325,287.

The present photosensitive emulsion or other hydrophilic colloid layers (such as protective layer, interlayer) can contain various surfactants such as a coating aid, antistatic agent, agent for reducing sliding friction, emulsifier, antiadhesion agent, photographic property-improver (for example, development promoter, high contrast producer, sensitizer).

For example, the following compounds can be used: a nonionic surfactant such as saponin (steroid-type), alkyleneoxide derivative such as polyethyleneglycol, polyethyleneglycol/polypropyleneglycol condensate, polyethyleneglycol alkylethens, polyethyleneglycol alkylarylathens, polyethyleneglycol esters, polyethyleneglycol sorbitan esters, polyalkyleneglycol alkylamines or amides, and polyethylene oxide additives of silicone, glycidol derivatives such as alkenylsuccinic polyglyceride and alkylphenol polyglyceride, fatty acid esters of polyhydric alcohol, alkylesters of sugar; an anionic surfactant containing an acidic group such as a carboxyl sulfo, phospho, sulfate or phosphate group, e.g. alkylcarboxylates, alkylsulfonates, alkylbenzenesulfonates, alkylnaphthalenesulfonates, alkylphosphates, N-acyl-N-alkyltaurines, sulfosuccinates, sulfoalkylpolyoxyethylenealkylphenylethers, polyoxyalkylphosphonates; an ampholytic surfactant such as amino acide, aminoalkylsulfonic acids, aminoalkyl sulfates or phosphates, and amineoxides; and a cationic surfactant such as alkylamine salts, aliphatic or aromatic tertiary ammonium salts, heterocyclic tertiary ammonium such as pyridinium, imidazolium, phosphonium or sulfonium salts containing aliphatic or heterocyclic ring.

In particular, the desirable antistatic agent may be a fluorine-containing surfactant as described in U.S. Pat. No. 4,201,586 and Japanese Patent Disclosure Nos. 60-80849 and 59-74554; a nonionic surfactant having an alkyleneoxide group as described in Japanese Patent Disclosure Nos. 60-76742, 60-80848, 60-80846, 60-80839, 58-208743 and 60-76741; and a polyacrylic acid as described in Japanese Patent Disclosure No. 57-20540. A desirable inorganic antistatic agent may be nitrates of alkali metals, and conductive tin oxide, zinc oxide or its complex oxide made by doping such oxide with autimony, etc. as described in Japanese Patent Disclosure No. 57-118242.

Specifically, the coating aids which are described in Research Disclosure Vol. 176 RD-17643 XI, can be used.

The internal latent image-type silver halide photographic emulsion of the present invention may contain a so-called colored coupler. The colored couplers usable in the present invention may be those mentioned in Research Disclosure, Vol. 176 RD-17643 (1978) VII.

The internal latent image-type silver halide photographic emulsion of the present invention may contain also a plasticizer, matting agent, lubricant, U.V. absorber, fluorescent brightening agent, aerial antifoggant, etc.

The photosensitive material prepared by using the internal latent image-type silver halide photographic emulsion of the present invention may contain a dye as a filter dye or for various purposes such as for the prevention of irradiation in the photographic emulsion layer or other hydrophilic colloid layer. The dyes thus usable in the present invention may be those mentioned in Research Disclosure, Vol. 176 RD-17643 (1978) VIII.

The present photosensitive material may contain, as well as a silver halide emulsion layer a hydrophilic colloid layer such as a surface protective layer, interlayer, filter layer and antihalation layer.

The layers such as a protective layer may contain polymethyl methacrylate homopolymer, copolymer of methyl methacrylate and methacrylic acid, starch, and fine grains such as silica (for example, 2–5 μm). The layers may also contain the aforementioned surfactants.

The surface protective layer may contain, as lubricants, silicone compounds which are described in U.S. Pat. Nos. 3,489,576 and 4,047,958, colloidal silica as described in Japanese Patent Publication No. 56-23139, paraffin max, higher fatty acid esters, starch derivatives and so on.

The present photosensitive material can be used for B/W direct positive photosensitive material which is described in Japanese Patent Disclosure Nos. 59-20854 and 60-26003, such as X-ray photosensitive material, dupe photosensitive material, micrography photosensitive material, photocomposition photosensitive material and printing photosensitive material; color direct positive photosensitive material using a coupler which is described in Japanese Patent Disclosure No. 58-70233, such as color paper and color photography photosensitive material; and color diffusion transfer direct positive photosensitive material which is described in Research Disclosure Vol. 151 No. 15162 page 75–87 (November, 1976).

The internal latent image-type silver halide photosensitive material of this invention forms reversed images by development in the presence of a fogging agent (nucleating agent), or development under overall light exposure. Examples of fogging agents that can be used according to the present invention include hydrazines as mentioned in U.S. Pat. Nos. 2,588,982 and 2,563,785; hydrazines and hydrazones as mentioned in U.S. Pat. No. 3,227,552; acylhydrazines as mentioned in British Patent No. 2,089,057; quaternary salts as mentioned in British Patent No. 1,283,835, Japanese Patent Publication No. 49-38164 and U.S. Pat. Nos. 3,615,615, 3,719,494, 3,734,738, 4,094,683 and 4,115,122; sensitizing dyes having a nucleating substituent in its molecule as mentioned in U.S. Pat. No. 3,718,470; and acylhydrazinophenylthiourea compounds as mentioned in U.S. Pat. Nos. 4,030,925 and 4,031,127. In addition, compounds as mentioned in U.S. Pat. No. 4,139,387 and Japanese Patent Disclosure Nos. 54-133126 and 54-74729 may also be used.

It is preferable that the fogging agent is used herein in such an amount that a sufficient maximum density can be obtained when the internal latent image-type silver halide emulsion of the present invention is developed with the surface developer. The fogging agent is incorporated preferably in the photographic emulsion layer or a layer adjacent thereto.

The internal latent image-type silver halide photographic emulsion of the present invention can be used for various purposes. Particularly, they are useful as emulsions for direct positive photographic materials, emulsions for multilayer reversal color photographic materials, and emulsions for multilayer structure color diffusion transfer process.

The photographic emulsion of the present invention can be used also in combination with a color image-forming substance for the diffusion transfer which releases a diffusing dye in response to the development of the silver halide, to form an intended transferred image on the image receiving layer after a suitable developing treatment. Various color image-donating materials for the diffusion transfer have been known. Examples of them include those mentioned in U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,635; 3,932,380, 3,954,476; 3,942,987 and 4,013,635; U.S.B. No. 351,673; British Patent Nos. 840,731, 904,364 and 1,038,331; West German Patent Disclosure (O.L.S.) Nos. 1,930,215, 2,214,381, 2,228,361 and 2,317,134, 2,402,900; French Patent No. 2,284,140; Japanese Patent Disclosure Nos. 51-113624 (corresponding to U.S. Pat. No. 4,055,428) and 51-104343 and Japanese Patent Disclosure Nos. 53-149328 and 53-143323. Among them, those which are essentially non-diffusing, but are cleaved by oxidation-reduction reaction with an oxidation product of the developing agent to release the diffusing dyes (hereinafter referred to as DRR compounds) are used preferably.

The photographic materials used in this invention can be developed using various developing agents. Examples of these agents include 4-polyhydroxybenzenes such as hydroquinone, 2-chlorohydroquinone, 2-methylhydroquinone, catechol and pyrogallol; aminophenols such as p-aminophenol, N-methyl-p-aminophenol and 2,4-diaminophenol; 3-pyrazolidones such as phenyl-3-pyrazolidone, 1-phenyl-4,4-dimethyl-3-pyrazolidone, phenyl-4-methyl-4-hydroxymethyl-3-pyrazolidone and 5,5-dimethyl-1-phenyl-3-pyrazolidone; and ascorbic acids. They may be used singly or as a combination thereof. Examples of the developing agents usable in this invention are those mentioned in Japanese Patent Disclosure No. 58-55928.

For obtaining a dye image in the presence of a dye-forming coupler, an aromatic primary amine developing agent, preferably a p-phenylenediamine-type developing agent can be used. Examples of such agents include 4-amino-3-methyl-N,N-dimethylaniline hydrochloride, N,N-diethyl-p-phenylenediamine, 3-methyl-4-amino-N-ethyl-N-β-(methane-sulfamido)ethylaniline, 3-methyl-4-amino-N-ethyl-N-(β-sulfoethyl)aniline, 3-ethoxy-4-amino-N-ethyl-N-(β-sulfoethyl)aniline and 4-amino-N-ethyl-N(β-hydroxyethyl)aniline. These developing agents may be present in an alkaline processing composition (processing element) or in a suitable layer of a photosensitive element.

When the DRR compound is used in the present invention, any silver halide developers capable of cross oxidizing the same can be used.

The developer may contain a preservative such as sodium sulfite, potassium sulfite, ascorbic acid or a reductone (such as piperidinohexose reductone).

The photosensitive material of the present invention can be developed using a surface developer to form a direct positive image. The development by the surface developer is induced substantially by the latent images or fogging nucleus on the silver halide grain surface. Although it is preferable that the developer is free of a silver halide solubilizer, the solubilizer (such as a sulfite) may be contained therein unless the internal latent image makes substantially no contribution to the development until the development by the surface development center of the silver halide grains has been completed.

The developer may contain sodium hydroxide, potassium hydroxide, sodium carbonate, potassium carbonate, trisodium phosphate, sodium metaborate, etc. as an alkali or buffering agent. The amount of the agent is controlled so that the pH of the developer is in the range of 10 to 13, preferably 11 to 12.5.

The developer may contain a color development accelerator such as benzyl alcohol. Advantageously, the developer contains a compound usually used as the antifoggant so as to further reduce the minimum density of the direct positive image. These compounds include, for example, benzimidazoles such as 5-nitrobenzimidazole; and benzotriazoles such as benzotriazole and 5-methylbenzotriazole.

The photosensitive material of the present invention can be processed also with a viscous developer.

The viscous developer is a liquid composition comprising components necessary for the development of the silver halide emulsion and also for the formation of the diffusion transfer dye image. The solvent in this composition comprises mainly water and, if necessary, a hydrophilic solvent such as methanol or methylcellosolve. The processing composition contains an alkali in an amount sufficient for maintaining a pH value necessary for the development in the emulsion layer and also for neutralizing an acid such as a hydrohalogenic acid, e.g. hydrobromic acid, cr a carboxylic acid, e.g. acetic acid formed in the steps for the development and dye image-forming. The alkalis include alkali metal and alkaline earth metal salts and amines such as lithium hydroxide, sodium hydroxide, potassium hydroxide, calcium hydroxide dispersion, tetramethylammonium hydroxide, sodium carbonate, trisodium phosphate and diethylamine. An alkali hydroxide having a high concentration corresponding to a pH of above about 12, particularly above 14 at room temperature is preferably used.

When the sensitive material of the present invention is used in the diffusion transfer photography, it is preferable that the sensitive material is in the form of a film unit. The film unit is to be processed by passing it through a pair of pressing members arranged in parallel. The film unit comprises essentially the following three elements:

1) a photosensitive element of the present invention containing the fogging agent.
2) an image-receiving element, and
3) processing element containing the silver halide developer and having a means of releasing the alkaline processing composition inside the film unit such as a burstable vessel.

The following examples will further illustrate the present invention.

EXAMPLE I

Emulsions A and B were prepared as follows:

Emulsion A

An aqueous potassium bromide solution and an aqueous silver nitrate solution were simultaneously added to an aqueous gelatin solution under vigorous stirring at 75° C. for 40 min. to obtain a silver bromide emulsion having an average grain diameter of 0.4 μm. Sodium thiosulfate and chloroauric acid (tetrahydrate) each in an amount of 4 mg per mole of silver were added to the resultant emulsion, and then the emulsion was heated at 75° C. for 80 min., to conduct chemical sensitization. The thus obtained silver bromide grains were used as the cores and grown under the same precipitation conditions as in the first step for 40 min., to obtain a core/shell-type silver bromide emulsion of monodisperse system having an average grain diameter of 0.6 μm. After washing with water and desalting, 0.9 mg, per mol of silver, of sodium thiosulfate was added to the emulsion and the mixture was heated at 65° C. for 60 min. to effect chemical sensitization. The product was internal latent image-type silver halide emulsion A-1.

Emulsion B

An aqueous potassium bromide solution and an aqueous silver nitrate solution were simultaneously added to an aqueous gelatin solution under vigorous stirring at 45° C. for about 40 min. to obtain a silver bromide emulsion having an average grain diameter of 0.20 μm. Sodium thiosulfate and chloroauric acid (tetrahydrate) each in an amount of 5 mg per mol of silver were added to the emulsion and the mixture was heated at 75° C. for 80 min. to effect chemical sensitization. The thus obtained silver bromide grains in the emulsion were used as the cores and grown under the same precipitation conditions as in the first step except that a pAg was controlled to be 7.90, to obtain a core/shell-type silver bromide emulsion of monodisperse system comprising octahedron grains having an average diameter of 0.35 μm. After washing with water and desalting, sodium thiosulfate and chloroauric acid (tetrahydrate) each in an amount of 2 mg was added to the emulsion and the mixture was heated at 65° C. for 60 min. to cause chemical sensitization, so as to obtain emulsion B.

Emulsions B-2 and B-3 were prepared in the same manner as in the above except that the pAg in the second precipitation process was 8.13 or 8.74. The ratio of the face (100) to the surface of the whole grains in each emulsion was determined according to a method described in Journal of Imaging Science, 29, 165 (1985). The other face was the face (111).

TABLE I

| Emulsion | Proportion of the face (100), % | Grain size |
|---|---|---|
| B-1 | 99 | 0.35 μm |
| B-2 | 83 | 0.32 |
| B-3 | 18 | 0.28 |

Emulsion A and one of Emulsions B-1 to B-3 were mixed with each other at a molar ratio of 3:2, and anhydro-2-[3-(phenylhydrazo)butyl]-3-(3-sulfopropyl) benzothiazolium hydroxide as a fogging agent was added to the resultant mixture in an amount of 257 mg per mole of silver. The coating of this mixture was made so that the total amount of the coated silver was 2.5 g/m2, and then a gelatin protective layer was coated thereon, to obtain Sample Nos. 11–13. In this case, sodium dodecylbenzenesulfonate as a coating aid was added to the emulsion layer and gelatin protective layer.

These samples were subjected to storage tests under two kinds of conditions: at 40° C. in 80% RH for 3 days and at 50° C. in 10% RH for 3 days.

The samples were exposed to 1 kw tungsten light through a step wedge at a color temperature of 2854° K. for 1 sec. Each of the samples was stirred in the following developer at 36° C. for 1 min. After the development followed by stopping, fixing, and washing with water effected in ordinary processes, a positive image was obtained.

| Developer | | |
|---|---|---|
| hydroquinone | | 45 g |
| sodium sulfite | | 100 g |
| potassium carbonate | | 20 g |
| sodium bromide | | 3 g |
| 1-phenyl-4-methyl-4-hydroxymethyl-#-pyrazolidone | | 3 g |
| 5-methylbenzotriazole | | 40 mg |
| water | add | 1 l |

pH of the developer was adjusted to 11.8 with potassium hydroxide.

In this case, the exposure latitude of the gradated portion as a Log E (E=exposure was 1.8).

The results are shown in Table 2 together with those of the fresh samples which were not subjected to the storage tests.

TABLE 2

| No. | | Emulsion B | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|
| 11 | Present Example | B-1 | 2.00 | 0.08 | 1.99 | 0.08 | 2.01 | 0.08 |
| 12 | Present Example | B-2 | 2.02 | 0.08 | 2.00 | 0.08 | 2.02 | 0.08 |
| 13 | Comparative Example | B-3 | 2.00 | 0.08 | 1.15 | 0.08 | 1.75 | 0.08 |

It is understood that Samples 11 and 12 provided extremely good storage stability, while in Comparative example 13, $D_{max}$ was decreased.

EXAMPLE 2

An emulsion C was prepared as follows:

Emulsion C:

An aqueous potassium bromide solution and an aqueous silver nitrate solution were simultaneously added to an aqueous gelatin solution under vigorous stirring at 40° C. for about 20 min. to obtain a silver bromide emulsion having an average grain diameter of 0.08 μm. Sodium thiosulfate and chloroauric acid (tetrahydrate) each in an amount of 5 mg per mol of silver were added to the emulsion and the mixture was heated at 75° C. for 80 min. to effect the chemical sensitization. The resultant silver bromide grains were used as the cores and grown under the same precipitation conditions as in the first step except that a pAg was controlled to be 7.90, to obtain a core/shell-type silver bromide emulsion of monodisperse system having an average grain diameter of 0.18 μm. After washing with water and desalting, sodium thiosulfate and chloroauric acid (tetrahydrate) each in an amount of 6.2 mg per mole of silver were added to the emulsion and the emulsion was heated at 65° C. for 60 min., to conduct chemical sensitization, so as to obtain Emulsion C-1.

Emulsions C-2 and C-3 were prepared in the same manner as the above except that a pAg in the second precipitation step was controlled to be 8.13 or 8.74, respectively. The ratio of the face (100) to the surface of the whole grains in each emulsion was determined according to a method described in *Journal of Imaging Science,* 29, 165 (1985). The other face was the face (111).

TABLE 3

| Emulsion | Proportion of the face (100), % | Grain size |
|---|---|---|
| C-1 | 98 | 0.18 μm |
| C-2 | 85 | 0.17 |
| C-3 | 15 | 0.16 |

Sample Nos. 21–23 were prepared in the same manner as in Example 1 except that Emulsion C was used in place of Emulsion B.

In this case, the exposure latitude of the gradated portion as a log E was 1.8.

The storage test results are shown in Table 4.

TABLE 4

| No. | | Emulsion C | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|
| 21 | Example | C-1 | 2.28 | 0.08 | 2.26 | 0.08 | 2.26 | 0.08 |
| 22 | Example | C-2 | 2.24 | 0.08 | 2.20 | 0.08 | 2.21 | 0.08 |
| 23 | Comparative Example | C-3 | 2.25 | 0.08 | 1.39 | 0.08 | 2.00 | 0.08 |

Even when the grain size of the smaller size core/shell-type emulsion becomes smaller to obtain a wider exposure latitude, the present invention provides a good storage stability.

EXAMPLE 3

To Emulsions C-1 and C-3 and A of Examples 1 and 2, anhydro-2-[3-(phenylhydrazo)butyl]-3-(3 -sulfopropyl) benzothiazolium hydrocide as a fogging agent was added in an amount of 257 mg per mole of silver. Emulsions C-1 to C-3 were coated as a lower layer in a coated Ag amount of 1.0 g/m$^2$, and Emulsion A was coated thereon as a upper layer in a coated Ag amount of 1.5 g/m$^2$. Then, a gelatin protective layer was coated thereon, to obtain Sample Nos. 31 to 33.

In this case, sodium dodecylbenzene sulfonate as a coating aid was added to the emulsion layers and the protective layer.

In addition, Sample Nos. 34 to 36 were prepared in the same manner as the above except that the amount of the fogging agent was 513 mg. in this case, the exposure latitude as defined as a log E was 3.0.

The storage test results are shown in Table 5.

TABLE 5

| No. | | Lower layer emulsion | Amount of fogging agent mg/mole silver | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|---|
| 31 | Example | C-1 | 257 | 2.27 | 0.08 | 2.25 | 0.08 | 2.25 | 0.08 |
| 32 | Example | C-2 | " | 2.25 | 0.08 | 2.20 | 0.08 | 2.22 | 0.08 |
| 33 | Comparative Example | C-3 | " | 2.25 | 0.08 | 1.35 | 0.08 | 2.20 | 0.08 |
| 34 | Example | C-1 | 513 | 2.26 | 0.08 | 2.25 | 0.08 | 2.24 | 0.08 |
| 35 | Example | C-2 | " | 2.25 | 0.07 | 2.20 | 0.07 | 2.20 | 0.07 |
| 36 | Comparative Example | C-3 | " | 2.25 | 0.08 | 1.50 | 0.08 | 2.10 | 0.08 |

EXAMPLE 4

Example 3 was repeated except that Sensitizing dye D-1 was added to Emulsions C-1 to C-3 in an amount of 140 mg per mole of silver, and to Emulsion D-1 in an amount of 200 mg per mole of silver. The test results are shown in Table 6.

TABLE 6

| No. | | Lower layer emulsion | Amount of fogging agent mg/mole silver | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|---|
| 41 | Example | C-1 | 257 | 2.27 | 0.08 | 2.25 | 0.08 | 2.25 | 0.08 |
| 42 | Example | C-2 | " | 2.25 | 0.08 | 2.20 | 0.08 | 2.22 | 0.08 |
| 43 | Comparative Example | C-3 | " | 2.25 | 0.07 | 1.45 | 0.08 | 1.90 | 0.08 |
| 44 | Example | C-1 | 513 | 2.26 | 0.08 | 2.23 | 0.08 | 2.25 | 0.08 |
| 45 | Example | C-2 | " | 2.24 | 0.08 | 2.22 | 0.08 | 2.22 | 0.08 |
| 46 | Comparative Example | C-3 | " | 2.24 | 0.08 | 1.50 | 0.08 | 2.00 | 0.08 |

The table shows that the present invention provides superior effects even when the spectral sensitization was made.

EXAMPLE 5

Example 3 was repeated except that 4-hydroxy-6-methyl-1,3,3,3a-tetrazaindene was added to the lower layer using Emulsion C-3 so that the above compound was present in an amount of 2 mg/m$^2$ or 10 mg/m$^2$. The results are shown in Table 7. In this case, the amount of the fogging agent was 513 mg/m$^2$.

TABLE 7

| No. | Amount added | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ | |
|---|---|---|---|---|---|---|---|---|
| 51 | 2 mg/m$^2$ | 2.25 | 0.08 | 1.85 | 0.08 | 2.13 | 0.08 | Comparative Example |
| 52 | 10 mg/m$^2$ | 2.28 | 0.13 | 2.23 | 0.15 | 2.24 | 0.23 | Comparative Example |

The table shows that the tetrazaindene does not substantially improve the storage stability and that the larger amount of the tetrazaindene used (Sample No. 52) has an effect for maintaining the $D_{max}$ level but has a draw-back of increasing $D_{min}$ of the fresh sample.

Thus, the table substantiates the superior effects of the present invention.

EXAMPLE 6

Sample Nos. 61 to 63 were prepared in the same manner as Example 3 except that sensitizing dye D-1 and the fogging agent used in Example 1 respectively in amounts of 140 mg and 257 mg/mole-silver were added to Emulsions C-1 and C-3 of Example 3, and then the resultant emulsions were coated as an innermost layer; that the same sensitizing dye and fogging agent respectively in amounts of 200 mg and 257 mole-silver were added to Emulsion B, and then the resultant emulsion was coated as an interlayer; and that the same sensitizing dye and fogging agent respectively in amounts of 200 mg and 257 mg/mole-silver were added to Emulsion A used in Example 1, and then the resultant emulsion was coated as an outermost layer. The coated silver amounts of the innermost layer, interlayer and outermost layer were respectively 1.0 g/m$^2$, 0.8 g/m$^2$, and 1.5 mg/m$^2$.

Sample Nos. 64 to 66 were prepared in the same manner as the above except that the amount of the fogging agent was 513 mg.

The test results are shown in Table 8.

TABLE 8

| No. | | Innermost layer emulsion | Amount of fogging agent mg/mole silver | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|---|
| 61 | Example | C-1 | 257 | 3.10 | 0.09 | 3.08 | 0.09 | 3.10 | 0.09 |
| 62 | Example | C-2 | " | 3.08 | 0.09 | 3.05 | 0.09 | 3.08 | 0.09 |
| 63 | Comparative Example | C-3 | " | 3.08 | 0.09 | 2.60 | 0.09 | 2.73 | 0.09 |
| 64 | Example | C-1 | 513 | 3.10 | 0.09 | 3.10 | 0.09 | 3.10 | 0.09 |

TABLE 8-continued

| No. | | Innermost layer emulsion | Amount of fogging agent mg/mole silver | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|---|
| 65 | Example | C-2 | " | 3.08 | 0.09 | 3.07 | 0.09 | 3.08 | 0.09 |
| 66 | Comparative Example | C-3 | " | 3.09 | 0.09 | 2.65 | 0.09 | 2.80 | 0.09 |

The table shows that the examples of the present invention (61, 62, 64, 65) provide good storage stability even when the emulsions are used in a three-layer structure.

EXAMPLE 7

Sample Nos. 71 to 73 were prepared in the same manner as Example 3 except that a fogging agent having the following formula (a):

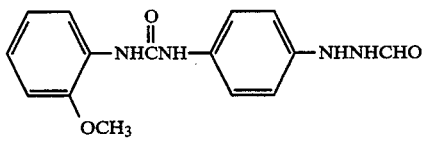

was used in an amount of 400 mg/mole-silver.

The test results obtained as conducted in the same manner as Example 1 are shown in Table 9.

TABLE 9

| No. | | Lower layer emulsion | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|
| 71 | Example | C-1 | 2.30 | 0.07 | 2.23 | 0.07 | 2.27 | 0.07 |
| 72 | " | C-2 | 2.32 | 0.07 | 2.25 | 0.07 | 2.26 | 0.07 |
| 73 | Comparative Example | C-3 | 2.29 | 0.07 | 1.65 | 0.07 | 2.15 | 0.07 |

EXAMPLE 8

Example Nos. 81 to 83 were prepared in the same manner as Example 3 except that a fogging agent having the following formula (b):

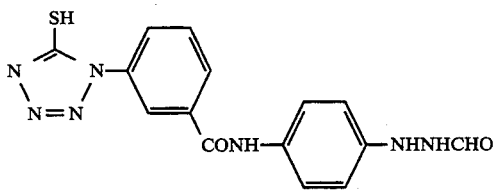

was used in an amount of 70 mm/mole-silver.

The storage test results obtained as conducted according Example 1 are shown in Table 10.

TABLE 10

| No. | | Lower layer emulsion | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|
| 81 | Example | C-1 | 2.20 | 0.08 | 2.18 | 0.08 | 2.18 | 0.08 |
| 82 | " | C-2 | 2.18 | 0.08 | 2.15 | 0.08 | 2.17 | 0.08 |
| 83 | Comparative Example | C-3 | 2.13 | 0.08 | 1.59 | 0.08 | 2.00 | 0.08 |

EXAMPLE 9

The following emulsions A and B were prepared as follows.

Emulsion A

An aqueous potassium bromide solution and an aqueous silver nitrate solution were added simultaneously to an aqueous gelatin solution under vigorous stirring at 40° C. for about 20 min. to obtain a silver bromide emulsion having an average grain diameter of 0.08 μm. Sodium thiosulfate and chloroauric acid (tetrahydrate) each in an amount of 580 mg per mole of silver were added to the emulsion and the mixture was heated at 75° C. for 80 min. to effect the chemical sensitization. The thus obtained silver bromide grains were used as the cores and grown under the same precipitation conditions as in the first step except that the pAg of the solution was controlled at 7.90 to obtain a core/shell-type silver bromide emulsion of monodisperse system having an average grain diameter of 0.18 μm. After washing with water and desalting, 6.2 mg, per mol of silver, each of sodium thiosulfate and chloroauric acid (hetrahydrate) were added to the emulsion and the mixture was heated at 65° C. for 60 min. to effect the chemical sensitization. The product was Emulsion A-1.

Emulsions A-2 and A-3 were obtained in the same manner as above except that the pAg of the solution was controlled at 8.13 or 8.74 in the second precipitation step. The ratio of the face (100) to the whole surface of the grains in each emulsion was determined according to a method described in *Journal of Imaging Science,* 29, 165 (1985). The other face was the face (111).

TABLE 11

| Emulsion | Proportion of the face (100) (%) |
|---|---|
| A-1 | 98 |
| A-2 | 85 |
| A-3 | 15 |

Emulsion B

An aqueous potassium bromide solution and an aqueous silver nitrate solution were added simultaneously to an aqueous gelatin solution under vigorous stirring at 75° C. for about 40 min. to obtain a silver bromide emulsion having an average grain diameter of 0.4 μm. Sodium thiosulfate and chloroauric acid (tetrahydrate) each in an amount of 4 mg per mol of silver were added to the emulsion and the mixture was heated at 75° C. for 80 min. to effect the chemical sensitization. The resultant silver bromide grains in the emulsion were used as the cores and grown under the same precipitation conditions in the first step for additional 40 min. to obtain a core/shell-type silver bromide emulsion of monodisperse system comprising octahedron grains having an average diameter of 0.6 μm. After washing with water and desalting, 0.9 mg, per mol of silver, of sodium thiosulfate was added to the emulsion and the mixture was heated at 65° C. for 60 min. to effect the chemical sensitization. The product was silver halide Emulsion B of internal latent image-type.

257 mg, per mol of silver, of anhydro-2-[3-(phenylhydrazolo)butyl]-3-(3-sulfopropyl)benzothiazolium hydroxide was added as a fogging agent to each of Emulsions A1 to A-3. One of Emulsions A-1 to A-3 was applied to support in such a manner that the amount of Ag was 1.0 g/m$^2$ to form a lower layer; and the emulsion B was applied thereto in such a manner that the amount of Ag was 1.5 g/m$^2$ to form an upper layer. Further, a gelatin was applied thereto to form a protective layer. Thus, Sample Nos. 11 to 13 were prepared.

In this operation, sodium dodecylbenzenesulfonate was incorporated as a coating aid in the emulsion layers and the gelatin protective layer. Further, Sample Nos. 14 to 16 were prepared in the same manner as above except that the amount of the fogging agent was changed to 513 mg.

These samples were stored at 40° C. in 80% RH atmosphere for 3 days or at 50° C. in 10% RH atmosphere for 3 days to conduct the storage tests.

The samples were exposed to 1 kW tungsten light through a step wedge at a color temperature of 2854.K for 1 sec. Each of the samples was stirred in the following developer at 36° C. for 1 min. After the development followed by stopping, fixing, and washing with water effected in ordinary processes, a positive image was obtained.

TABLE 12

| No. | | Lower layer emulsion | Amount of fogging agent mg/mole silver | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|---|
| 111 | Example | A-1 | 257 | 2.27 | 0.08 | 2.25 | 0.08 | 2.25 | 0.08 |
| 112 | " | A-2 | " | 2.25 | 0.08 | 2.20 | 0.08 | 2.22 | 0.08 |
| 113 | Comparative Example | A-3 | " | 2.25 | 0.08 | 1.35 | 0.08 | 2.00 | 0.08 |
| 114 | Example | A-1 | 513 | 2.26 | 0.08 | 2.25 | 0.08 | 2.24 | 0.08 |
| 115 | Example | A-2 | " | 2.25 | 0.07 | 2.20 | 0.07 | 2.20 | 0.07 |
| 116 | Comparative Example | A-3 | " | 2.25 | 0.08 | 1.50 | 0.08 | 2.10 | 0.08 |

| Developer | |
|---|---|
| hydroquinone | 45 g |
| sodium sulfite | 100 g |
| potassium carbonate | 20 g |
| sodium bromide | 3 g |
| 1-phenyl-4-methyl-4-hydroxymethyl-3-pyrazolidone | 3 g |
| 5-methylbenzotriazole | 40 mg |
| water | ad 1 l |

A pH of the developer C was adjusted to 11.8 with potassium hydroxide. The results are shown in Table 12 in comparison with those of the fresh samples which had not been subjected to the tests.

It is understood that Sample Nos. 111, 112, 114 and 115 which were embodiments of the present invention had a quite excellent storage stability, while $D_{max}$ of the comparative samples was reduced in the storage tests.

EXAMPLE 10

Example 9 was repeated except that 140 mg of Sensitizing dye D-1 per mol of silver was added to each of Emulsions A-1 to A-3 and 200 mg thereof was added to Emulsion B. The results are shown in Table 13.

TABLE 13

| No. | | Lower layer emulsion | Amount of fogging agent mg/mole silver | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|---|
| 121 | Example | A-1 | 257 | 2.27 | 0.08 | 2.25 | 0.08 | 2.25 | 0.08 |
| 122 | " | A-2 | " | 2.25 | 0.08 | 2.20 | 0.08 | 2.22 | 0.08 |
| 123 | Comparative Example | A-3 | " | 2.25 | 0.07 | 1.45 | 0.08 | 1.90 | 0.08 |
| 124 | Example | A-1 | 513 | 2.26 | 0.08 | 2.23 | 0.08 | 2.25 | 0.08 |
| 125 | " | A-2 | " | 2.24 | 0.08 | 2.22 | 0.08 | 2.22 | 0.08 |
| 126 | Comparative Example | A-3 | " | 2.24 | 0.08 | 1.50 | 0.08 | 2.00 | 0.08 |

It is understood that the remarkable effects of the present invention could be obtained even in the cases where the spectral sensitization was made.

EXAMPLE 11

Example 9 was repeated except that 2 mg/m$^2$ or 10 mg/m$^2$ of 4-hydroxy-6-methyl-1,3,3,3a-tetrazaindene was added to the lower layer of Emulsion A-3. The results are shown in Table 14. The amount of the fogging agent was 513 mg/m$^2$.

TABLE 14

| No. | Addition amount | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ | |
|---|---|---|---|---|---|---|---|---|
| 131 | 2 mg/m$^2$ | 2.25 | 0.08 | 1.85 | 0.08 | 2.13 | 0.08 | Comparative Example |
| 132 | 10 mg/m$^2$ | 2.28 | 0.13 | 2.23 | 0.15 | 2.24 | 0.23 | Comparative Example |

It is apparent from Table 14 that the storage stability could scarcely be improved by using the tetrazaindene (No. 131) and that $D_{min}$ of the fresh sample was increased even in case the tetrazaindene was used in a large amount (sample No. 132), although the $D_{max}$-maintaining effects could be obtained. The effects of the present invention are thus apparent.

EXAMPLE 12

Emulsion C was prepared as follows:

Emulsion C:

An aqueous potassium bromide solution and an aqueous silver nitrate solution were added simultaneously to an aqueous gelatin solution under vigorous stirring at 45° C. for about 40 min. to obtain a silver bromide emulsion having an average grain diameter of 0.2 μm. Sodium thiosulfate and chloroauric acid (tetrahydrate) each in an amount of 5 mg per mol of silver were added to the emulsion and the mixture was heated at 75° C. for 80 min. to cause the chemical sensitization. The resulting silver bromide grains were used as the cores and grown under the same precipitation conditions as in the first step for 40 min. to obtain a core/shell-type silver bromide emulsion of monodisperse system comprising octahedron grains having an average diameter of 0.35 μm. The emulsion was divided into two equal portions. Sodium thiosulfate and chloroauric acid (tetrahydrate) each in an amount shown in Table 13 were added thereto and the mixture was heated at 65° C. for 60 min. to cause the chemical sensitization. The product was silver halide emulsion C of internal latent image type.

A mixture of one of Emulsions A-1 to A-3 prepared in Example 9 with Sensitizing dye D-1 and the same fogging agent as in Example 9 respectively in amounts of 140 mg and 257 mg per mol of silver was applied to a support to form the innermost layer. A mixture of Emulsion C and the sensitizing dye and fogging agent respectively in amounts of 200 mg and 257 mg per mol of silver, was applied thereto to form an intermediate layer. A mixture of Emulsion B prepared in Example 9 with the same sensitizing dye and fogging agent respectively in amounts of 200 mg and 257 mg, was applied thereto to form an outer layer. Other conditions were the same as in Example 9. In this way, Samples 141 to 143 were prepared. The amounts of silver in the innermost, intermediate and outer layers were 1.0 g/m$^2$, 0.8 g/m$^2$ and 1.5 mg/m$^2$, respectively. Samples 144 to 146 were prepared in the same manner as above except that the amount of the fogging agent was altered to 513 mg. The same storage tests as in Example 9 were carried out to obtain the results shown in Table 15.

TABLE 15

| No. | | Lower layer emulsion | Amount of fogging agent mg/mole silver | Fresh $D_{max}$ | Fresh $D_{min}$ | 40° C., 80% RH, 3 days $D_{max}$ | 40° C., 80% RH, 3 days $D_{min}$ | 50° C., 10% RH, 3 days $D_{max}$ | 50° C., 10% RH, 3 days $D_{min}$ |
|---|---|---|---|---|---|---|---|---|---|
| 141 | Example | A-1 | 257 | 3.10 | 0.09 | 3.08 | 0.09 | 3.10 | 0.09 |
| 142 | " | A-2 | " | 3.08 | 0.09 | 3.05 | 0.09 | 3.08 | 0.09 |
| 143 | Comparative Example | A-3 | " | 3.08 | 0.09 | 2.60 | 0.09 | 2.73 | 0.09 |
| 144 | Example | A-1 | 513 | 3.10 | 0.09 | 3.10 | 0.09 | 3.10 | 0.09 |
| 145 | " | A-2 | " | 3.08 | 0.09 | 3.07 | 0.09 | 3.08 | 0.09 |
| 146 | Comparative Example | A-3 | " | 3.09 | 0.09 | 2.65 | 0.09 | 2.80 | 0.09 |

It is understood that the sample Nos. 141 and 142 which were the embodiments of the present invention have an excellent storage stability. The remarkable effects of the present invention can be obtained also when the three layers of the emulsions were formed.

EXAMPLE 13

This experiment was conducted to show that the smaller grains must have a photographic speed of 2 to 20% of than that of the larger grains, in order to obtain a broad latitude.

Figure 2:
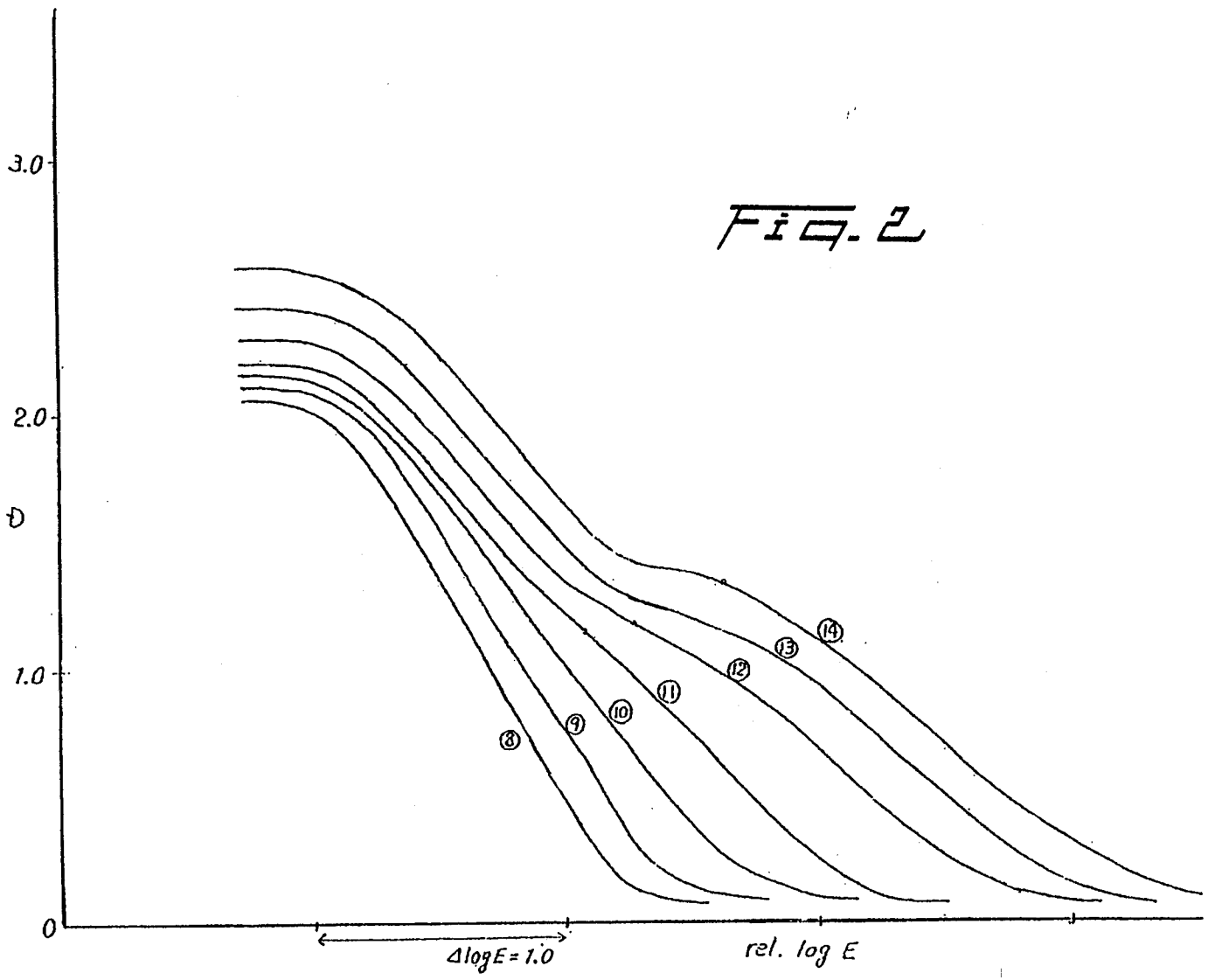

As a larger grain emulsion, the core/shell type silver bromide emulsion in Example 1 was used. Smaller size grain emulsions were prepared in the same manner as the procedure of Emulsion C in Example 2, except that the temperature and time when the aqueous potassium bromide solution and the aqueous silver nitrate solution were mixed with each other in the process of forming a core grain, were changed. Emulsions C1 to C7 had grains of various sensitivities as shown in Table 16. Samples were prepared and exposed in the same manner as in Example 1. The exposure latitude, sensitivity, and gradation linearity of the samples were determined. The results were listed in the following Table and illustrated in FIGS. 1 and 2.

TABLE 16

| Sample | Emulsion | Relative Sensitivity | Latitude | Linearity |
|---|---|---|---|---|
| 1 | A | 100 | 0.95 | good |
| 2 | C1 | 50 | 1.00 | good |
| 3 | C2 | 36 | 1.15 | good |
| 4 | C3 | 20 | 1.00 | good |
| 5 | C4 | 11 | 1.20 | good |
| 6 | C5 | 2 | 1.20 | good |
| 7 | C6 | 1 | 1.40 | good |
| 8 | C7 | 0.6 | 1.45 | good |
| 9 | A + C1 | 72 | 1.26 | good |
| 10 | A + C2 | 60 | 1.40 | good |
| 11 | A + C3 | 46 | 1.75 | good |
| 12 | A + C4 | 31 | 2.07 | good |
| 13 | A + C5 | 19 | 2.65 | good |

TABLE 16-continued

| Sample | Emulsion | Relative Sensitivity | Latitude | Linearity |
|---|---|---|---|---|
| 14 | A + C6 | 13 | 2.90 | bad |
| 15 | A + C7 | 8 | 3.22 | bad |

Note:

(1) Relative Sensitivity

Relative value of the reciprocal of the amount of exposure necessary to give a density of (Dmax+Dmin)/2.

(2) Exposure latitude

Logarithm of the ratio of the exposure amount necessary to give a density of Dmin-0.05 to that necessary to give a density of Dmax-0.05.

(3) Linearity

Degree of the gamma of the shoulder portion of the characteristic curve having two steps. When the gamma of the shoulder portion is 0.5 or higher, the linearity is good.

The Table and Figures show that Sample Nos. 11 to 13 are superior to the other samples in both the exposure latitude and linearity of the characteristic curve.

What is claimed is:

1. A direct positive photosensitive material having at least one internal latent image-type silver halide emulsion layer on a support, said emulsion layer comprising a binder and core/shell-type silver halide grains, wherein at least two types of core/shell silver halide grains having different grain sizes are contained in the same emulsion layer or in different emulsion layers, the smaller of the two types of grains being substantially constituted of cubic grains or of tetradecahedron grains mainly of the face (100), wherein the smaller grains (i) are chemically Sensitized on the surface thereof by at least one of a sulfur sensitization process, a reduction sensitization process, or a noble metal sensitization process, (ii) have an average grain size of 0.5 microns or smaller and (iii) have a sensitivity which is 2 to 20% of the sensitivity of the larger grains, and wherein the smaller grains widen the exposure latitude of the photosensitive material.

2. The direct positive photosensitive material according to claim 1, said photosensitive material having a D vs Log E characteristic curve having two steps and a good linearity, where D is Density and E is Exposure.

3. The photosensitive material of claim 2, where the $D_{max}$ of said photosensitive material is not significantly reduced when the photosensitive material is stored at high humidity and/or room temperature.

4. The photosensitive material of claim 1, wherein the average grain size of the smaller grains is smaller by 20% or more than those of the other larger grains.

5. The photosensitive material of claim 1, wherein the average grain size of the smaller grains is 0.15–0.50 μm.

6. The photosensitive material of claim 5, wherein the average grain size of the smaller grains is 0.15–0.40 μm.

7. The photosensitive material of claim 1, wherein said at least two types of core/shell silver halide grains are monodispersed.

8. The photosensitive material of claim 1, wherein said at least two types of core/shell silver halide grains having different grain sizes are contained in the same emulsion layer.

9. The photosensitive material of claim 1, wherein said at least two types of core/shell silver halide grains having different grain sizes are contained in different emulsion layers.

10. The photosensitive material of claim 9, wherein the number of said different emulsion layers is two or three.

11. The photosensitive material of claim 10, wherein the smaller grains are contained in the emulsion layer nearest to the support.

12. The photosensitive material of claim 1, wherein each of said emulsion layers provided on the support has a different color sensitivity.

13. The photosensitive material of claim 1, wherein a sensitizing dye or a togging agent is contained in said at least one emulsion layer.

14. The process according to claim 1 wherein the larger grains are chemically sensitized on the surface thereof by at least one of a sulfur sensitization process, a reduction sensitization process, or a noble metal sensitization process.

15. The photosensitive material of claim 14, wherein said at least two types of core/shell silver halide grains are prepared by forming a silver halide core which has been chemically sensitized and/or doped with a metal ion, coating the core with a silver halide to form the shell, and then chemically sensitizing the shell.

* * * * *

UNITED STATES PATENT AND TRADEMARK OFFICE

CERTIFICATE OF CORRECTION

PATENT NO. :5,364,750

DATED :November 15, 1994

INVENTOR(S) :Tetsuo YOSHIDA et al

It is certified that error appears in the above-indentified patent and that said Letters Patent is hereby corrected as shown below:

TITLE PAGE

In Section [63], kindly delete "790,091" and insert -- 790,021 --.

In Column 1, line 6, delete "790,091" and insert -- 790,021 --.

Signed and Sealed this

Seventh Day of February, 1995

*Attest:*

Bruce Lehman

BRUCE LEHMAN

*Attesting Officer*

*Commissioner of Patents and Trademarks*